US008032075B2

(12) United States Patent
Yoshizawa

(10) Patent No.: US 8,032,075 B2
(45) Date of Patent: Oct. 4, 2011

(54) BROADCAST RADIO SYSTEM

(75) Inventor: Masayoshi Yoshizawa, Tokyo (JP)

(73) Assignee: Hitachi Kokusai Electric Inc., Tokyo (JP)

( * ) Notice: Subject to any disclaimer, the term of this patent is extended or adjusted under 35 U.S.C. 154(b) by 430 days.

(21) Appl. No.: 12/382,149

(22) Filed: Mar. 10, 2009

(65) Prior Publication Data

US 2009/0233637 A1 Sep. 17, 2009

(30) Foreign Application Priority Data

Mar. 11, 2008 (JP) ..... 2008-061153

(51) Int. Cl.
*H04H 20/74* (2008.01)

(52) U.S. Cl. ..... 455/3.02

(58) Field of Classification Search ..... None
See application file for complete search history.

(56) References Cited

U.S. PATENT DOCUMENTS 7,907,889 B2 * 3/2011 Fujita et al. ..... 455/3.02
2007/0232220 A1 * 10/2007 Moore ..... 455/3.01

* cited by examiner

*Primary Examiner* — Lincoln Donovan
*Assistant Examiner* — Sibin Chen
(74) *Attorney, Agent, or Firm* — Bacon & Thomas, PLLC

(57) ABSTRACT

Each of terminals for use in a regional broadcast radio system includes a measuring unit for measuring an electric field value of a received signal of a specific frequency; a comparing unit for comparing the electric field value of the received signal with a predetermined electric field value; a scanning unit for scanning a specific frequency band when the electric field value of the received signal is equal to or less than the predetermined value; a frequency detecting unit for detecting a frequency of a maximum received electric field; and an information detecting unit for detecting whether notification information is included in a reception signal of the detected frequency. Each of terminals further includes an acquiring unit for acquiring a district code from the detected notification information; and a district code changing unit for setting the acquired district code as a district code of each of terminals.

7 Claims, 10 Drawing Sheets

BROADCAST RADIO SYSTEM

FIELD OF THE INVENTION

The present invention relates to a radio communication system allowing a master station to communicate with and terminals by radio, and more specifically, to a broadcast radio system which enables the execution of effective notification between a master station and terminals.

BACKGROUND OF THE INVENTION

For example, in a general regional broadcast radio system (or a regional simultaneous communication system), a master station is installed in an administrative agency, and a plurality of terminals are installed outside or inside of facilities in the administrative district administered by the agency, so that notification information such as disaster-related information is transmitted by radio from the master station to those terminals.

The broadcast radio systems are provided on an administrative district (e.g., country, town or ward) basis and communication from the master station to the terminals are carried out by radio. Therefore, when same broadcast radio systems are operated in neighboring districts (or regions), there may occur crosstalk interference of radio waves between broadcast radio systems in the districts. Because of this, as a measure for preventing such a crosstalk problem, there is a control operation, in which different frequencies are allocated to different broadcast systems and a district (or region) district code is transmitted as a scramble code when transmitting information by radio. In such a central operation, if the scramble code in the notification information received by a terminal does not coincide with a pre-registered scramble code therein, information reception is not executed. Hereinafter, a broadcast radio system between a master station and a terminal which are originally belong to a same district will be referred to as a "intra-broadcast radio system", and a broadcast radio system between a master station and a terminal in different districts will be referred to as an "inter-broadcast radio system".

FIG. 6 illustrates an example of a configuration of a digital regional broadcast radio system 200.

In FIG. 6, components that are similar to those shown in FIGS. 1A and 1B related to an embodiment of the present invention to be described later are given the same reference characters. The regional broadcast radio system 200 shown in FIG. 6 includes, e.g., a master station E, and a plurality of terminals which include plural terminal stations F1-Fn, and a number of house receivers G1-Gm.

The master station E includes a base station radio transceiver 1 having a controller 11, a radio unit 12, and an antenna 13 to execute radio communication; an operation table 2 for operating in response to a command to receive various kinds of instructions; and a text transmitter 3 for operating in response to a command to execute the input of text messages and the transmission of text.

Each of the terminal stations F1-Fn includes a terminal station main body 21 having a controller 31, a radio unit 32, and an antenna 33 to execute radio communication; a connection box 22 functioning as an interface for connecting the terminal station main body 21 with other components 23 and 24; a horn speaker 23 outputting sound including alarm and/or voice, in response to a command; and a display 24 displaying text information and the like in response to a command. Each of the house receivers G1-Gm includes a display unit 41 for displaying information and the like.

In the regional broadcast radio system 200, for example, if a terminal under in the intra-broadcast radio system tries to receive notification information from the inter-broadcast radio system, the reception frequency and the district code of the terminal state device under the intra-broadcast radio system are changed by those for the inter-broadcast radio system, so that the terminal under the intra-broadcast radio system can receive the notification information in the inter-broadcast radio system.

[Non-Patent Document 1] regional digital simultaneous communication system, ARIB STD-T86, Association of Radio Industries and Businesses (http://www.arib.or.jp/english/html/overview/doc/1-STD-T86v3_0.pdf)

In an emergent disaster where the digital regional broadcast radio system is most frequently used, a terminal under the intra-broadcast radio system is occasionally lent out to inter-broadcast radio system, so that disaster information of a neighboring district can be acquired. In this case, according to the technique disclosed in the Non-Patent Document 1, a worker personally must change the set-up by following the complicate set-up procedure, which takes a certain amount of time (several minutes). Because of this, immediate responses and fast actions are difficult to be performed. Further, as a fire fighting radio system, for example, disaster recovery activities across administrative districts (e.g., country, town or ward) and the like, are required as countermeasures of emergent disasters. Also, the regional broadcast radio system is required not only for transmitting information within the intra-broadcast radio system, but also for receiving notification information from inter-broadcast radio system. Therefore, there is a need for a function of providing all local residents with notification information such as proper, accurate information related to disaster and the like.

SUMMARY OF THE INVENTION

The present invention provides a technique for radio communication between a master station and its child station device (e.g., a terminal station or a house receiver) to provide effective notification to both the master station and the child station device (terminal).

In accordance with a first embodiment of the present invention there are provided terminals for use in a regional broadcast radio system including a master station connected, by radio, to the terminals directly or through predetermined relay stations, the terminals receiving and outputting notification information broadcasted from the master station.

Each of the terminals includes a movement permission acquiring unit for acquiring, when moving from a communication coverage in the regional broadcast radio system, in which the terminal station has belonged to, to a communication coverage in another regional broadcast radio system, a reception permission received from the master station in the regional broadcast radio system allows the terminal to receive notification information from a master station of the another regional broadcast radio system; and a reception switching unit for switching, if the reception permission is granted, a reception of the terminal to receive notification information broadcasted from the master station in the another regional broadcast radio system.

In addition, the terminal includes an electric field information acquisition unit for acquiring radio electric field information received from the plural master stations, and the receive switch unit may refer to the electric field information when switching the reception.

Also, the terminal includes a unique information acquisition unit for acquiring, from each of the plural master stations, unique information relevant to and set for the respective master stations, and a setup unit for storing unique information of a master station that permits the reception. Preferably, the receive switch unit may receive the notification information from a master station corresponding to the unique information that is stored in the setup unit.

Further, the terminal includes a timer processing unit, which acquires, from a center station in the regional broadcast radio system it belongs to, a valid period for enabling the reception of broadcast communication from a master station in the broadcast radio system, and which receives the broadcast communication from the master station in the regional broadcast radio system during the acquired valid period.

In accordance with a second aspect of the present invention, there is provided a master station for use in a regional broadcast radio system including a master station connected, by radio, to terminals directly or through a relay station, the terminals receiving and outputting notification information broadcasted from the master station.

The master station transmits to the terminals the notification information including control information for permitting a reception of notification information received from a master station in another regional broadcast system.

Preferably, the master station may notify the terminal of the valid period for enabling the reception of the broadcast communication.

In accordance with a third embodiment, there is provided a regional broadcast radio system including a master station connected, by radio, to terminals directly or through predetermined relay stations, the terminals receiving and outputting notification information broadcasted from the master station.

Each of the terminals includes: a movement permission acquiring unit for acquiring, when moving from a communication coverage in the regional broadcast radio system, in which the terminal has belonged to, to a communication coverage in another broadcast radio system, a reception permission received from the master station in the regional broadcast radio system allows terminal to receive notification information from a master station of the another broadcast radio system; and a reception switching unit for switching, if the reception permission is granted, a reception of the terminal to receive notification information broadcasted from the master station in the another broadcast radio system.

The master station in the regional broadcast system transmits to the terminal the notification information including control information for permitting the reception of notification information from the master station in the another broadcast radio system.

BRIEF DESCRIPTION OF THE DRAWINGS

The objects and features of the present invention will become apparent from the following description of preferred embodiments, given in conjunction with the accompanying drawings, in which.

DETAILED DESCRIPTION OF THE EMBODIMENTS

Figure 1A:
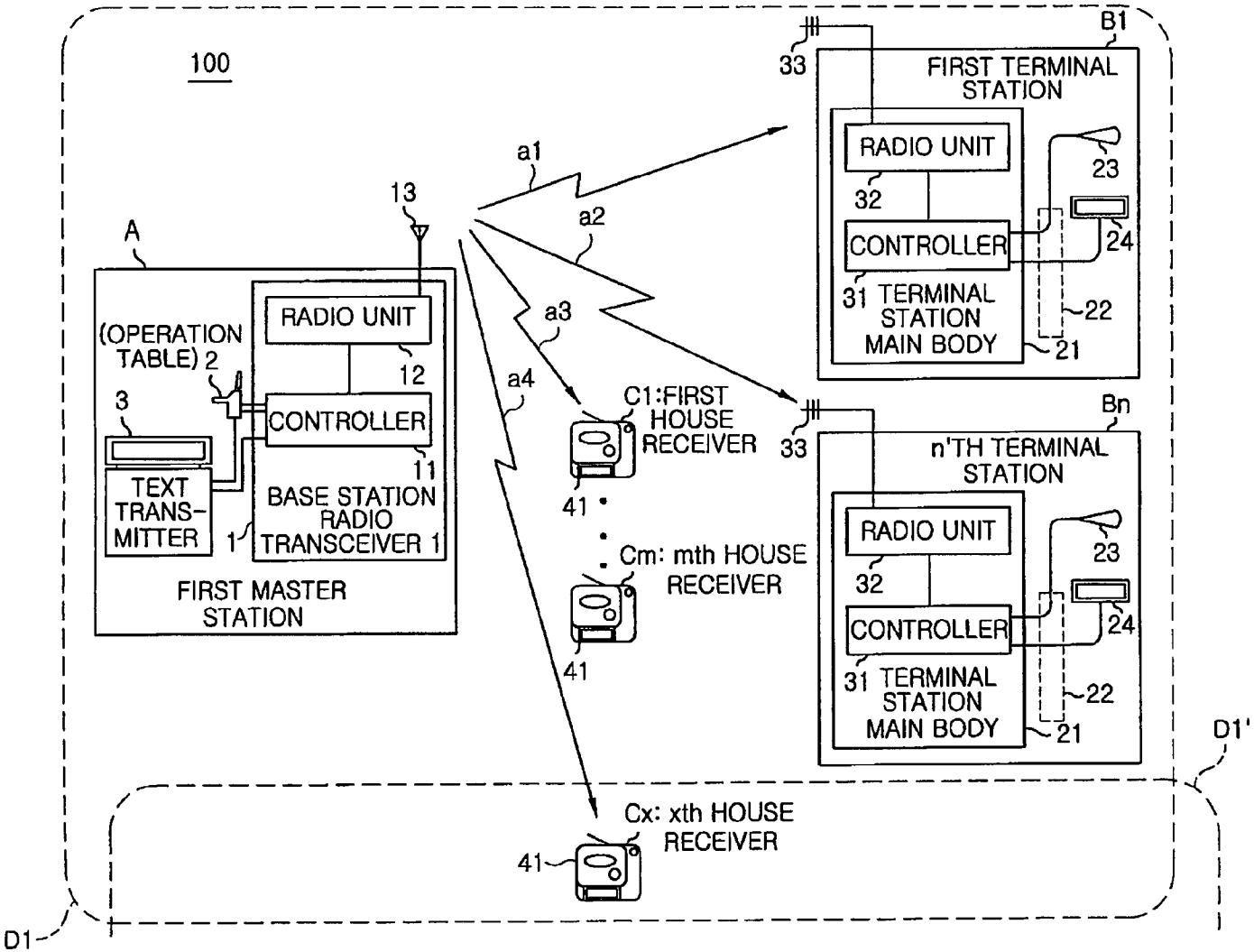
FIGS. 1A and 1B are views showing the configuration of first and second broadcast radio systems in accordance with an embodiment of the present invention.

The embodiments of the present invention will be described with reference to the accompanying drawings which form a part hereof. In the embodiment, an example where the present invention is applied to a digital regional broadcast radio system which is a fire fighting radio communication system in an administrative district (hereinafter, referred to simply as "broadcast radio system") will be explained.

The overall application of the regional broadcast radio system in accordance with the embodiment of the present invention is explained. The regional broadcast radio system notifies disaster related information that is obtained from an administrative agency, for example, when it occurs. That is, notification information broadcasted, in a form of radio signals, from the master station is received in plural terminals provided at predetermined locations, and is outputted. For a specific example, there is a regional broadcast radio system used for fire fighting administration, which is a district digital fire fighting radio communication scheme, based on about a 60 MHz band (i.e., in a range from 54 to 70 MHz) TDMA-TDD (Time Divisional Multiple Access-Time Divisional Duplexing) scheme. This regional broadcast radio system realizes the functions of executing the notification of information in a form of voice over phone calls, text or other code between the master station and the terminal, generating/outputting analog voice for public address out of the text information, other code information or the like, and generating/outputting a text message for text notification out of the analog voice for public address, other analog voice or the like.

For example, when disaster occurs, the regional broadcast radio system in accordance with this embodiment simultaneously notifies disaster related information from an administrative agency to residents. More specifically, in order to deliver information to residents, an operation table or a base station radio transceiver installed at the master station transmits disaster related information, information on an emergency instruction, information on evacuation advice or the like to terminals installed outdoors, houses, assembly halls, schools and the like in a form of voice information over phone calls, non-voice information by text messages or the like. The terminals are connected to or include therein a loudspeaker, text display or another display device, and output the voice information transmitted from the master station through the speaker or display text information on the display. The communication system can be adapted to, for example, a fixed communication system in which a terminal is fixedly provided, or a mobile communication system, i.e., a movable terminal like a mobile phone.

The overall process of the regional broadcast radio system in accordance with the embodiment is explained. When a certain terminal station (or a house receiver) in a communication coverage under the intra-broadcast radio system moves to another communication coverage under inter-broadcast radio system, the terminal detects a reduction in the received input electric field of an electric wave that is sent from the master station. Next, if the reduction in the received input electric field is less than a predetermined value, the terminal scans all frequency bands used in the regional broadcast radio system and automatically adjusts its reception frequency to a frequency of high received input electric field. After that, the terminal receives, by using the frequency it has fixed with, notification information of inter-broadcast radio system after movement and acquires a scramble code that is unique information from the notification information. The corresponding scramble code gets overwritten as a district code of the intra-station. Moreover, a terminal that is installed near the boundary between the intra-broadcast radio system and inter-broadcast radio system is changed unintentionally to the inter-broadcast radio system. As for a countermeasure of the former case, an operator of the intra-broadcast radio system transmits a control signal for the use of broadcast communication and the permission of movement to a terminal that permits the movement from the master station to inter-broadcast radio system. Only the terminal that received the control signal proceeds with a switch operation to inter-broadcast radio system, in accordance with a predetermined switch procedure. Hereinafter, the configuration and the process of the present invention are explained.

Figure 1B:
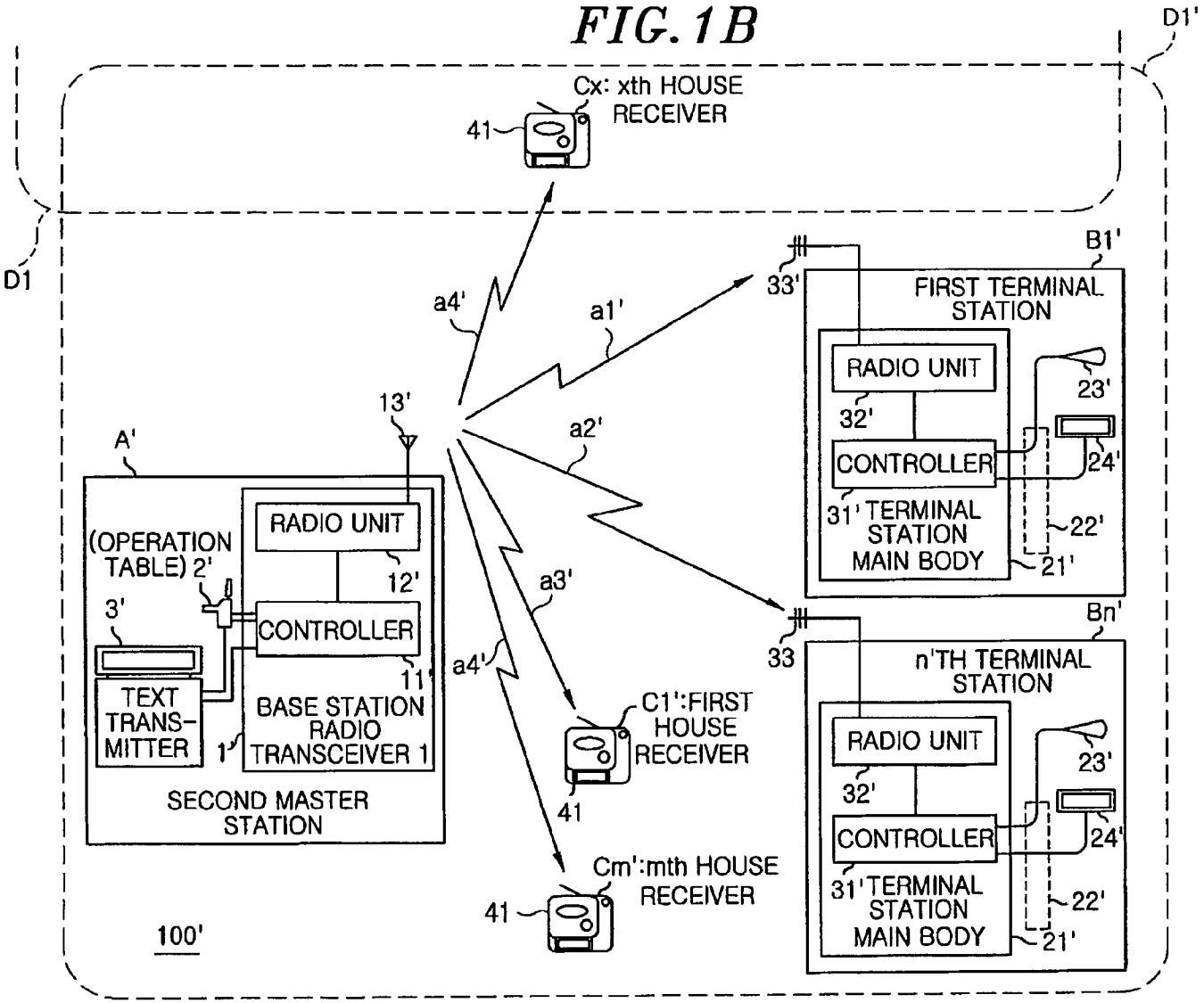

As shown in FIGS. 1A and 1B, a regional broadcast radio system 100 in accordance with the embodiment of the present invention includes a first master station A, first to nth terminal stations B1-Bn, and first to mth house receivers C1-Cm. Random numbers may be selected for "n" of the first to nth terminal stations B1-Bn, and "m" of the first to mth house receivers C1-Cm. Further, in accordance with the embodiment of the present invention, the first to nth terminal stations B1-Bn are provided at different locations of area, and the first to mth house receivers C1-Cm are provided at each residence (per household) in an administrative district or held by individuals (users).

In general, the direction of communication from the base station device (first and second master stations 100 and 100') to the terminal stations B1-Bn and B1'-Bn' or to the house receivers C1-Cm and C1'-Cm' is called "downward", while the direction of communication from the terminal stations B1-Bn and B1'-Bn' or from the house receivers C1-Cm and C1'-Cm' to the base station devices (first and second master stations 100 and 100') is called "upward".

FIG. 1A shows a first communication coverage D1 of the first master station A, a first radio line a1 between the first master station A and the first terminal station B1, a second radio line a2 between the first master station A and the nth terminal station Bn, and a third radio line a3 between the first master station A and the first house receiver C1. FIG. 1A further shows a fourth radio line a4 between the first master station A and the Xth house receiver Cx. The Xth house receiver Cx (where $1 \leqq X \leqq m$) is also included in a second communication coverage D1' of the second master station A' shown in FIG. 1B, as described later.

Although the embodiment mainly covers communication between the first master station A and the first to mth house receivers C1-Cm, similar operation between the first master station A and the first to mth house receivers C1-Cm may also be applied to the operation between the first master station A and the first to nth terminal stations B1-Bn.

The first master station A includes a base station radio transceiver 1 having a controller 11 a radio unit 12 and an antenna 13 to execute radio communication, an operation table 2 for operating in response to a command to receive all kinds of instructions, and a text transmitter 3 for operating in response to a command to perform the input of text messages and the transmission of text. Although the text transmitter 3 in the embodiment is connected to the base station radio transceiver 1, it may be connected to the operation table 2 to perform the input of text messages and the transmission of text therethrough. Also, the operation table 2 may include the function of the text transmitter 3 to realize the same function.

The first to nth terminal stations B1-Bn each include a terminal station main body 21 having a controller 31, a radio unit 32 and an antenna 33 to execute radio communication, a connection box 22 serving as an interface for connecting the terminal station main body 21 with other components 23 and 24, a horn speaker 23 for outputting voice in response to a command, and a display 24 for displaying a text information in response to a command.

The first to mth house receivers C1-Cm each include a display 41 for displaying a text information. Although this embodiment illustrates the system configuration in which the first to nth terminal stations B1-Bn and the first to mth house receivers C1-Cm are connected directly to the first master station A via the radio lines a1 to a3, another system configuration in which a relay station (not shown) is provided, and the first master station A is connected to the first to nth terminal stations B1-Bn and/or the first to mth house receivers C1-Cm through the relay station may also be used.

Further, the embodiment includes a digital regional broadcast radio system provided near the first master station, which includes a second master station A', first to nth terminal stations B1'-Bn', and first to mth call receives C1'-Cm'. The second master station A' has a second communication coverage D1', and the configuration thereof is same as that of the first master station A Therefore, the components provided in the second communication coverage D1' will be denoted by reference numerals with "'".

The Xth house receiver Cx exists in a zone that belongs to both the first and second communication coverages D1 and D1' of the first and second master stations A and A', and is connected to the first master station A and the second master station A' via the fourth radio line a4 and the fourth radio line a4', respectively. More details on the operation thereof will be described in the following embodiments 1 to 3.

First Embodiment

In the present embodiment, the base station radio transceiver 1 of the first master station A is respectively connected to the first to nth terminal stations B1-Bn and the first to mth house receivers C1-Cm via the first to third radio lines a1 to a3. The Xth house receiver Cx under the first communication coverage D1 of the first master station A is presumably moved to the second communication coverage D1' of the second master station A'.

Figure 2:
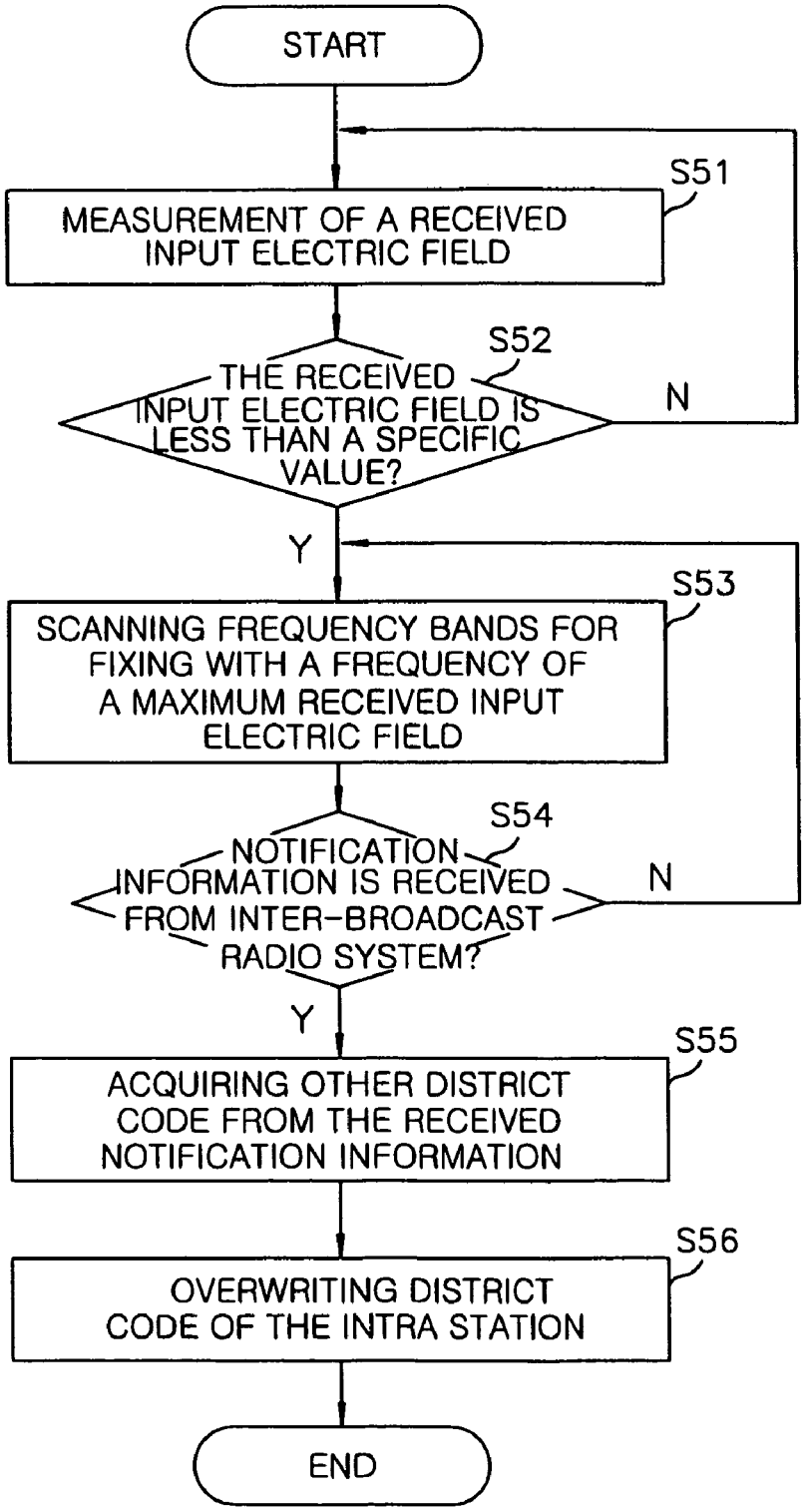
FIG. 2 is a flow chart describing a process in accordance with a first embodiment of the present invention.

Referring to the flow chart in FIG. 2, an example of a process of such broadcast communications is explained.

The process has a processing sequence of measuring a received input electric field in step S51, comparing the value of the received input electric field with a specific value in step S52, scanning a frequency band to detect a frequency of a maximum input electric field and fixing therewith in step S53, receiving notification information from inter-broadcast radio system in step S54, acquiring, in step S55, another district code from the notification information received in step S54, and overwriting the obtained district code on its district code in step S56. The following is a more detailed explanation about the process.

When the Xth house receiver Cx moves, by a user carrying it, from the first broadcast radio system 100, which is a intra-broadcast radio system, to the second broadcast radio system 100', which is inter-broadcast radio system, the value of an input electric field received from the first broadcast radio system 100 decreases. At this time, the Xth house receiver Cx measures, the received input electric field of the frequency of the intra-broadcast radio system in step S51 and decides whether the measured received input electric field is equal or less that a predetermined value in step S52. This processing is continuously performed when the received input electric field value is above the predetermined value (N in step S52).

When the value of the received input electric field is equal to or less than the predetermined value (Y in step S52), the Xth house receiver Cx decides that it is got out from the first broadcast radio system 100 (the intra-broadcast radio system) and then scans a frequency band which seems to be used generally by the regional broadcast radio system, to know whether inter-broadcast radio system exists nearby the Xth house receiver Cx, such that it can participate in inter-broadcast radio system in step S53.

Once a frequency of the maximum received input electric field is detected, the Xth house receiver Cx is fixed with the detected frequency, and detect whether there is notification information to find out if the corresponding frequency is being used for the regional broadcast radio system in step S54. If there is no notification information (N in step S54), the house receiver returns to the process step S53 to scan a frequency once again.

Meanwhile, if there is notification information (Y in step S54), the Xth house receiver Cx acquires from the notification information a district code of corresponding inter-broadcast radio system in step S55.

After acquiring the district code of inter-broadcast radio system, the Xth house receiver Cx overwrites the obtained district code on its district code.

Thus, in accordance with the present embodiment, although the Xth house receiver Cx moves from a coverage of a intra-broadcast radio system originally designated to a coverage of inter-broadcast radio system, as it has moved from the first communication coverage D1 to the second communication coverage D1', it is possible to receive information of the regional broadcast radio system just after the movement.

Second Embodiment

The basic configuration of this embodiment is similar to that of the first embodiment. When the Xth house receiver Cx is provided at the boundary between a first broadcast radio system 100 which is the intra-broadcast radio system and a second broadcast radio system 100' which is inter-broadcast radio system, there is a possibility that a house receiver which is not subjected to move out from the intra-broadcast radio system may arbitrarily participate in the inter-broadcast radio system, according to the description in the First Embodiment. To avoid such a situation, in this embodiment, master stations A and A' provide control information, thereby preventing the house receiver from arbitrarily participating in inter-broadcast radio system.

Figure 3A:
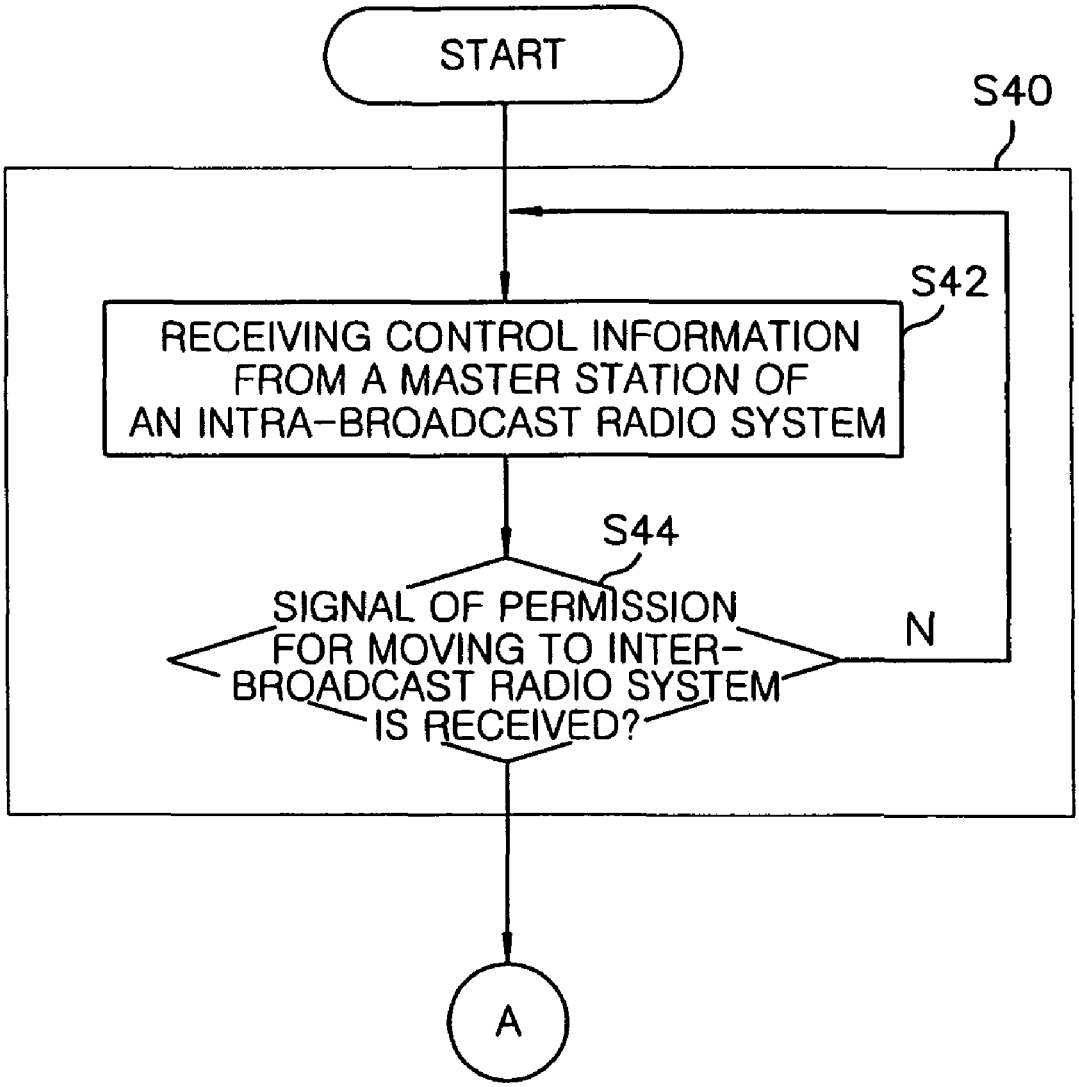
FIGS. 3A and 3B are flow charts describing a process in accordance with a second embodiment of the present invention.
Figure 3B:
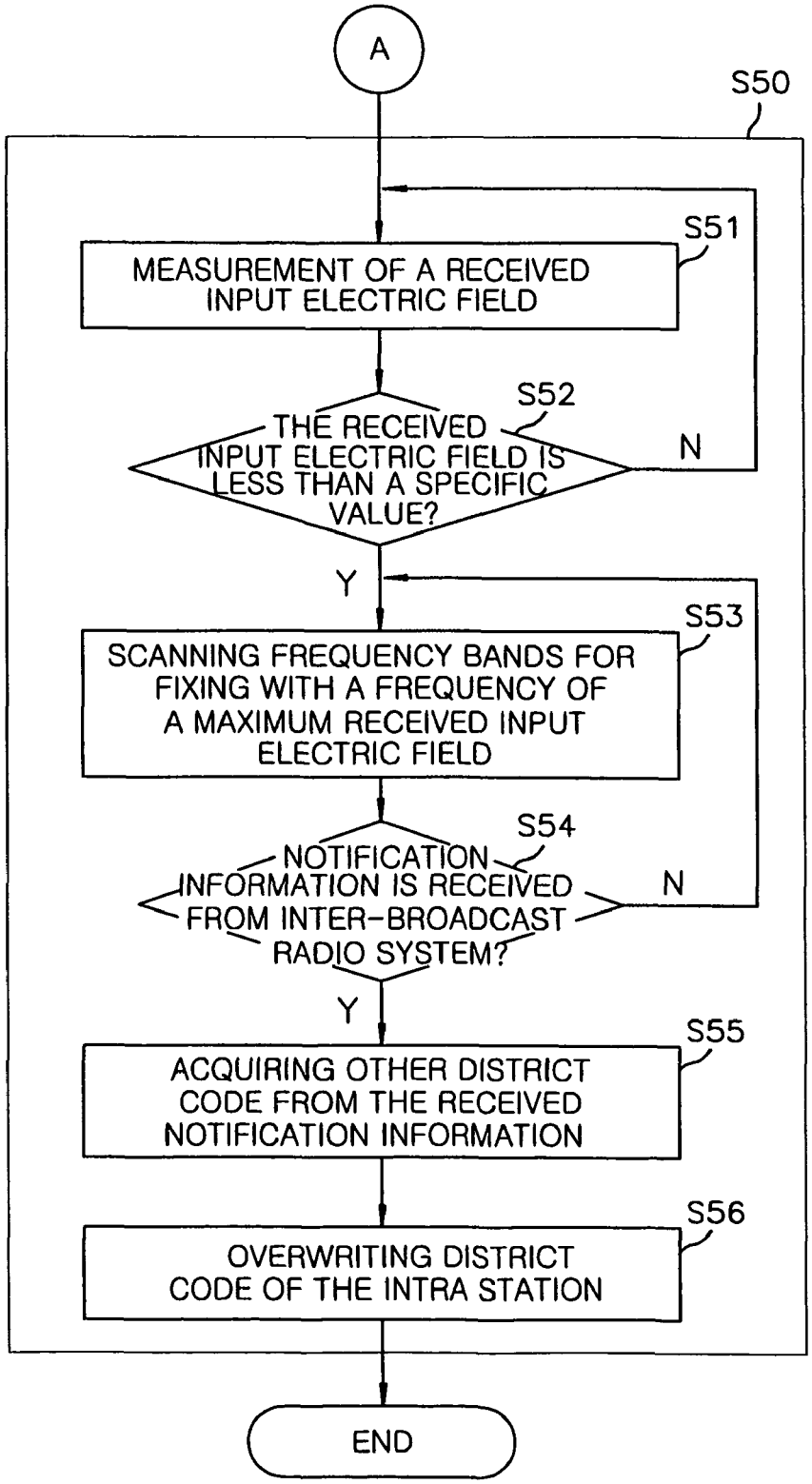

Referring to FIGS. 3A and 3B, an example of the process of such broadcast communication is described.

FIGS. 3A and 3B include a processing flow in which a single house receiver Cx, which is one of the terminals in the regional broadcast radio systems 100 and 100' shown in FIGS. 1A and 1B, moves from the first communication coverage D1 to the second communication coverage D1', and, therefore, processing steps shown in FIGS. 3A and 3B are partially same as processing steps shown in FIG. 2 of the First Embodiment. In the following description, the steps S51 to S56 shown in FIG. 2 are summarized and called a code change process S50 in case of movement. The present embodiment differs from the First Embodiment in that a movement permission step S40 is executed before the code change process S50 in case of movement is performed. The movement permission process S40 includes a step S42 of receiving control information from a master station in the intra-broadcast radio system and a step S44 of determining whether to move to inter-broadcast radio system or not.

As described in the First Embodiment, it is assumed that the Xth house receiver Cx in the first communication coverage D1 of the first master station A moves to the second communication coverage D1' of the second master station A'. When the Xth house receiver Cx under the intra-broadcast radio system 100 participates in the inter-broadcast radio system 100', the master station A of the intra-broadcast radio system 100 sends control information to the Xth house receiver Cx, which is the movement object to permit its movement. Upon receiving the control information in step S42, the Xth house receiver Cx checks whether it has received a signal permitting a movement to another system, that is, it determines whether it can move based on the control information or not in step S44. If the movement is permitted (Y in step S44), the house receiver participates in inter-broadcast radio system 100' by the internal process described in the First Embodiment (the code change process S50 in case of movement). However, if the movement is not permitted (N in step S44), the house receiver returns to the step S42.

Therefore, in accordance with the present embodiment, a terminal station (or a house receiver) is prevented from unintentionally participating in inter-broadcast radio system.

Third Embodiment

The basic configuration of the present embodiment is similar to that of the Second Embodiment, except that a valid period is given for the Xth house receiver Cx to participate in inter-broadcast radio system.

Figure 4A:
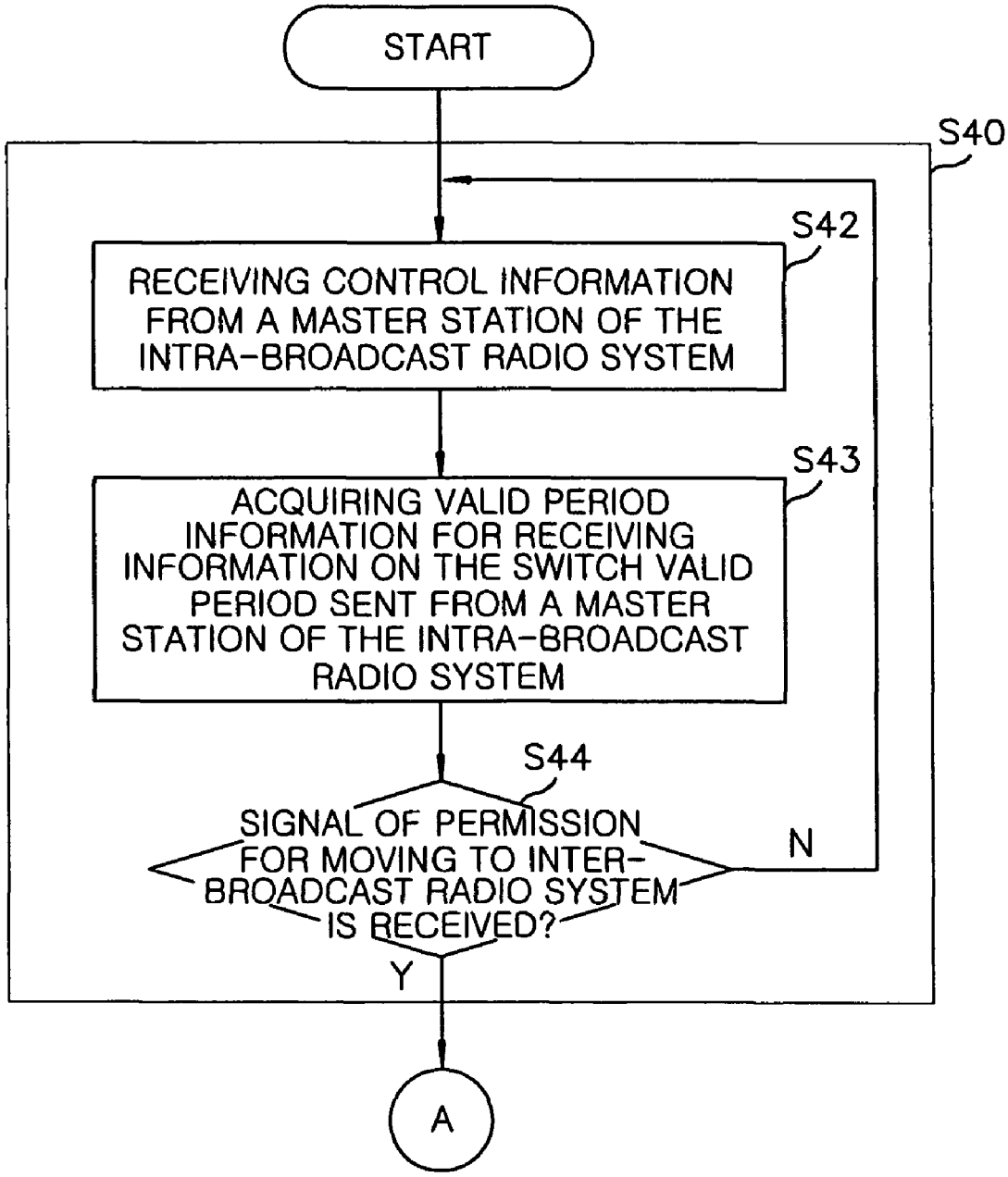
FIGS. 4A to 4C are flow charts describing a process in accordance with a third embodiment of the present invention.
Figure 4B:
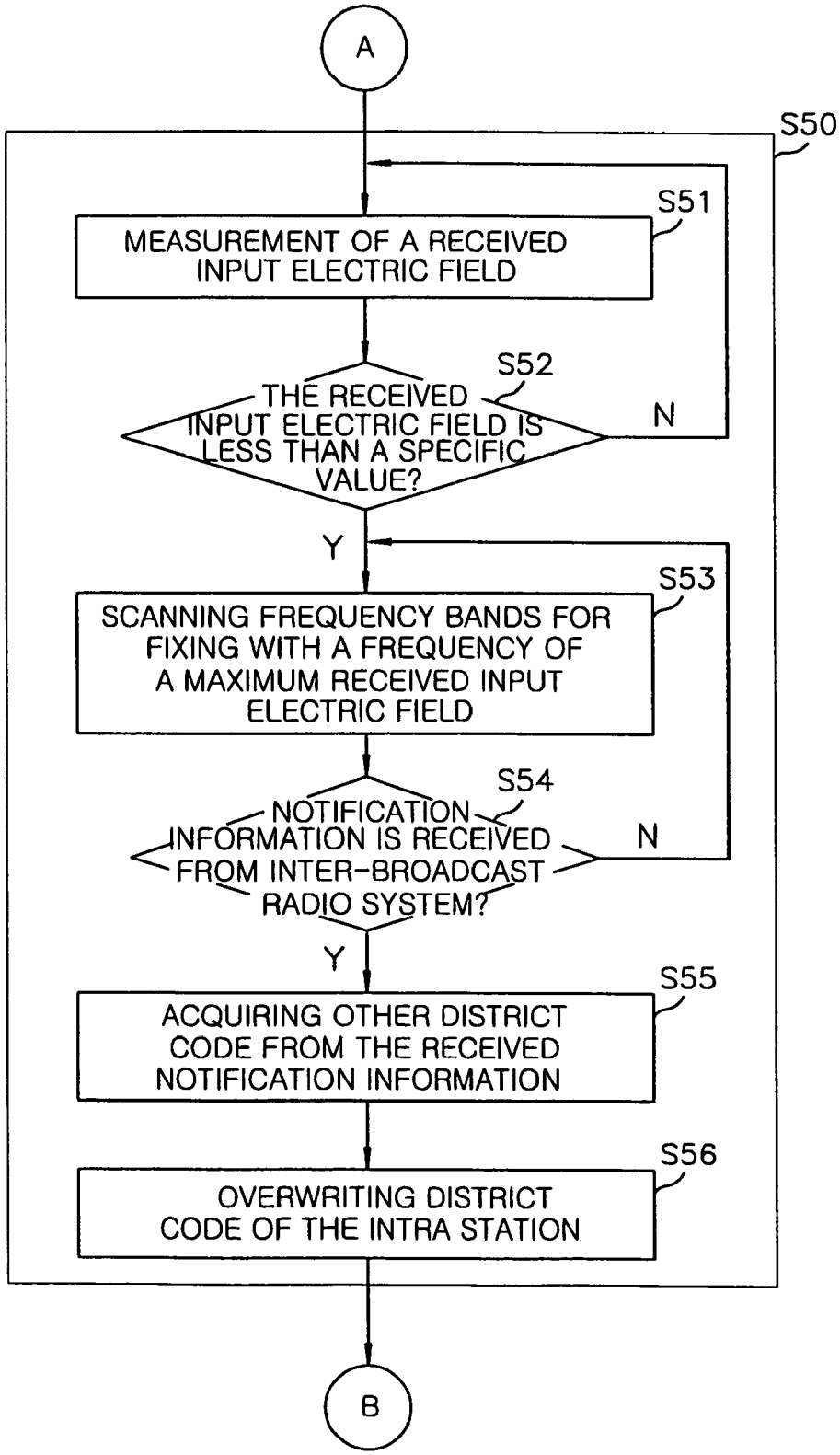
Figure 4C:
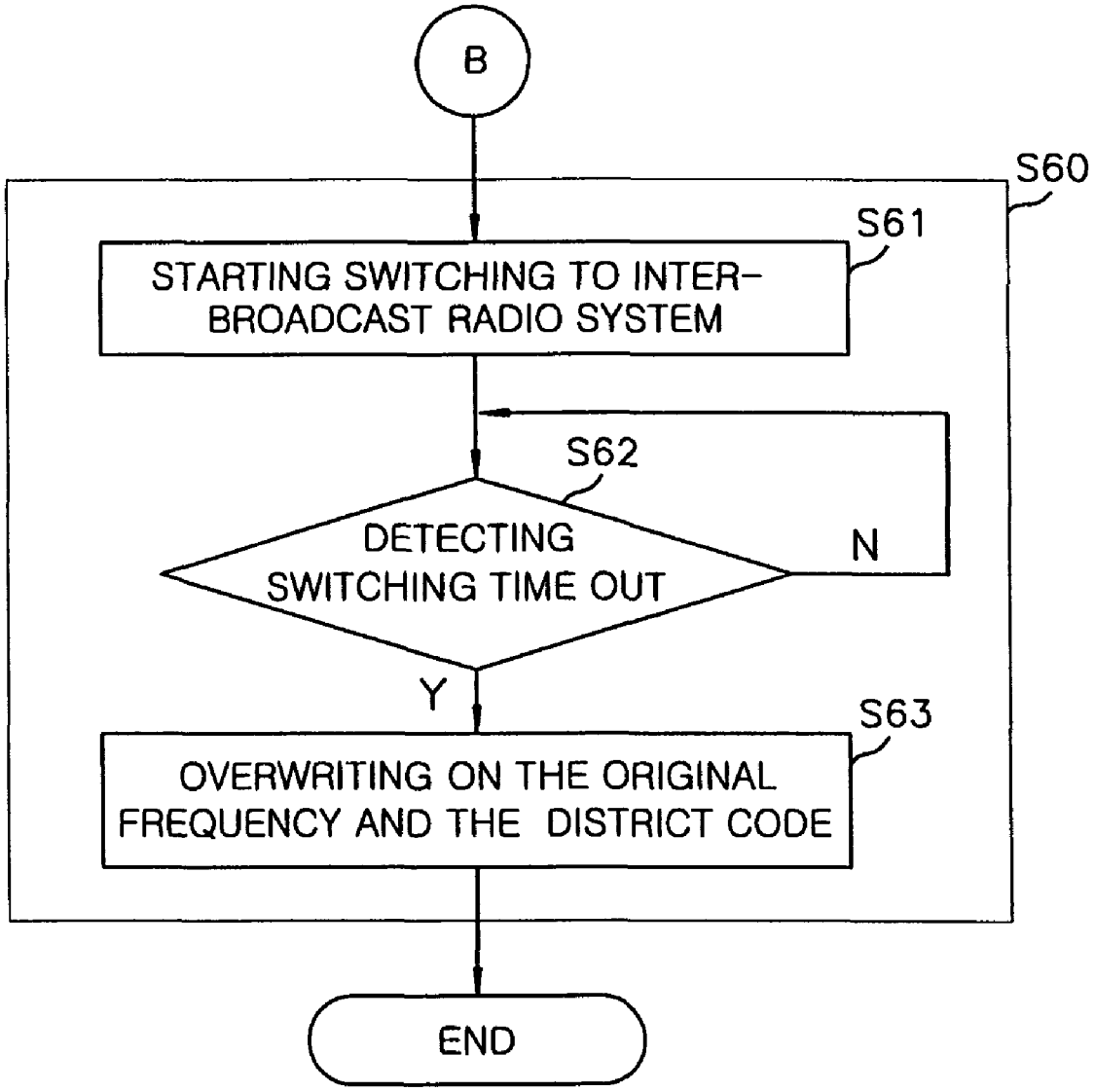

Referring to FIGS. 4A to 4C, an example of the process of such broadcast communication is now described. FIGS. 4A to 4C include a processing in which a single house receiver Cx, which is one of the terminals in the regional broadcast radio systems 100 and 100' shown in FIGS. 1A and 1B, moves from the first communication coverage D1 to the second communication coverage D1'. Therefore, the processing steps shown in FIGS. 4A to 4C are partially same as the steps shown in FIGS. 3A and 3B of the Second Embodiment, except that it further includes a step S43 of acquiring validity period information for receiving information on the switching valid period sent from a master station A in the intra-broadcast radio system 100 in the step S40 of the Second Embodiment, and a timer control step S60 to execute a timer operation based on the validity period information that is received in S43, after performing the code change step S50 in case of movement. The timer control step S60 includes a step S61 for starting timer counting when the house receiver Cx participates in the inter-broadcast radio system 100' inter-broadcast radio system, a step S62 for detecting a switching time out, and a step S63 for turning back to the original frequency and the district code.

In accordance with the present embodiment, in the regional broadcast radio systems 100 and 100' shown in FIG. 1, the Xth house receiver Cx participates in the communication coverage D1' of the second master station A' included in the second broadcast radio system 100'. Here, the first master station A in the intra-broadcast radio system transmits, to the Xth house receiver Cx which is a movement object, control information to permit its movement as well as a valid period which is a permission period of switching to inter-broadcast radio system.

Therefore, upon receipt of the control information (step S42) and the valid period (step S43), the Xth house receiver Cx determines that the movement to the second broadcast radio system 100', i.e., the inter-broadcast radio system, is permitted in S44 and, then, it executes the code change process S50 in case of movement. In succession, the Xth house receiver Cx executes the timer control process S60, that is, it starts counting the switch timer in S61 and if the timer value reaches the switch valid period (Y in S62) it the original frequency and the district code are recovered in the house receiver in S63. This timer control process S60 practically starts from the point when the Xth house receiver Cx participates in the D1' of the second broadcast radio system 100', i.e., the inter-broadcast radio system.

Therefore, in accordance with the present embodiment, since a valid period is given for a house receiver to participate in inter-broadcast radio system, even though the house receivers moves to inter-broadcast radio system temporarily and returns to its original broadcast radio system after a certain period of time has elapsed, it can get back to the original regional broadcast radio system without further operations, thereby achieving suitable operations without a restoration of the original set-up.

As a representative example of a terminal that executes the process described above, the configuration of the first house receiver C1 is now explained. The description will mainly focus on a controller 31 provided in the house receiver C1.

Figure 5:
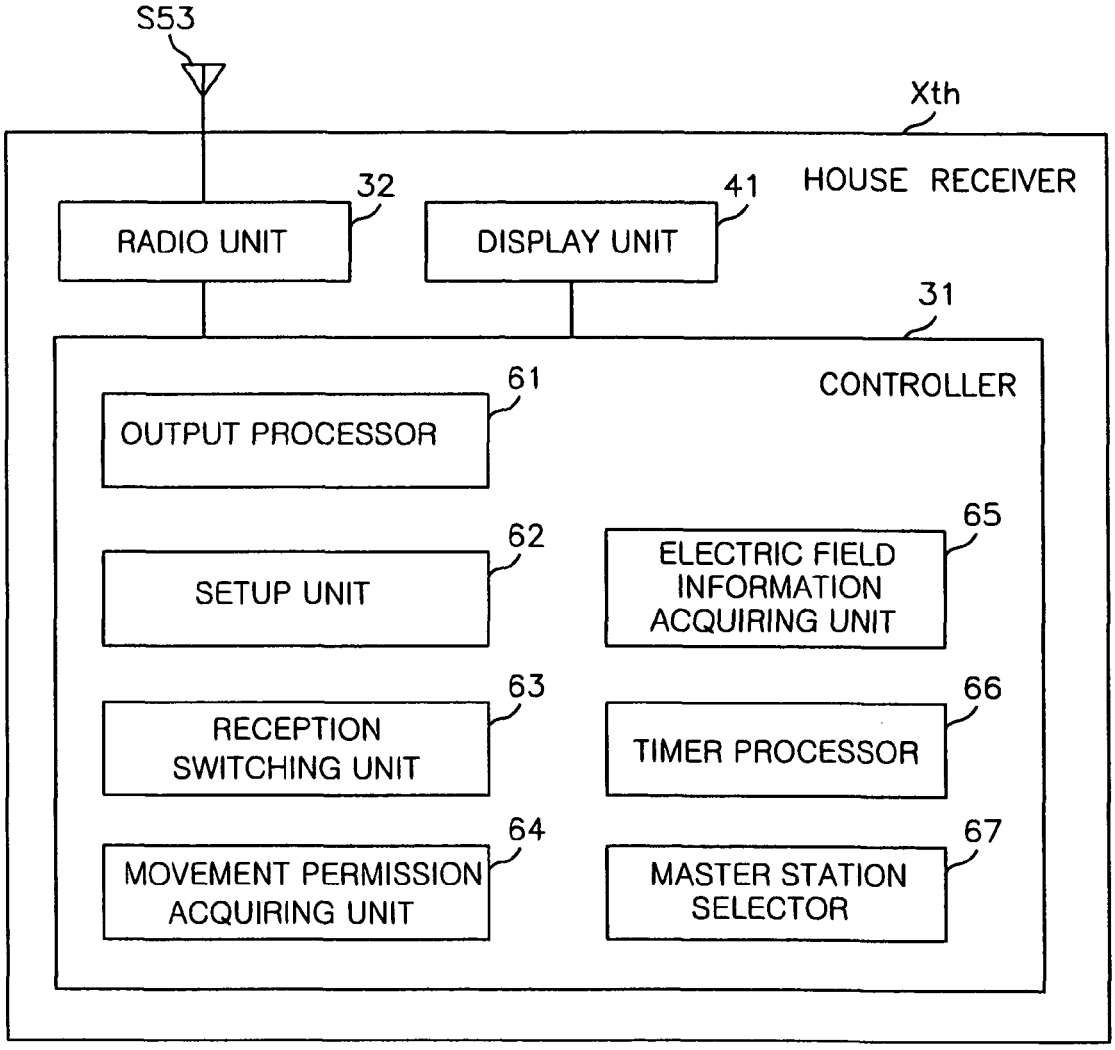
FIG. 5 is a functional block diagram showing the configuration of a first house receiver in accordance with an embodiment of the present invention.
Figure 6:
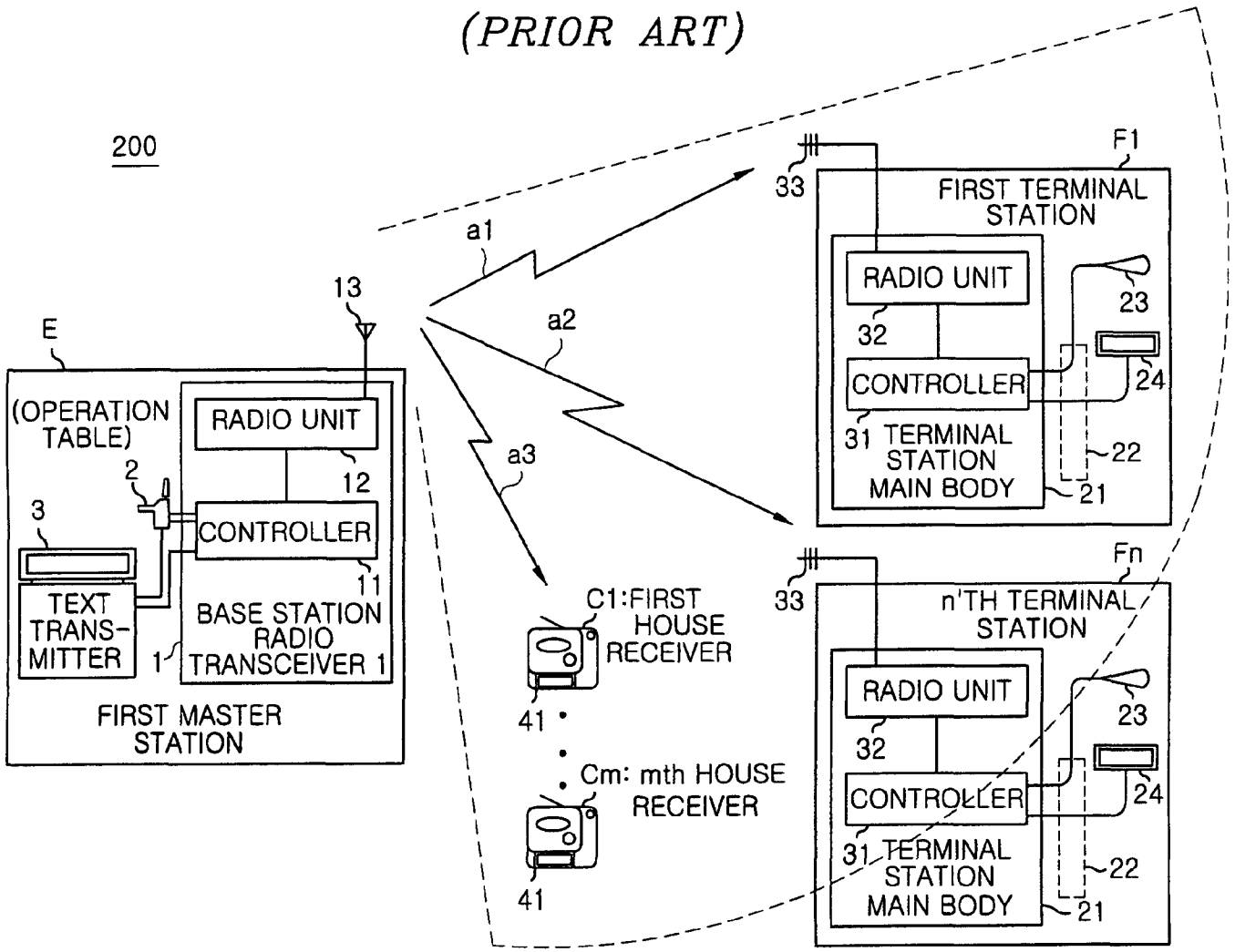
FIG. 6 (PRIOR ART)
FIG. 6 is a view showing the configuration of a conventional regional broadcast radio system.

FIG. 5 is a functional block diagram showing the configuration of the Xth house receiver Cx in accordance with the embodiment 3 of the present invention.

As shown therein, the Xth house receiver Cx includes a radio unit 32, a controller 31, and a display 41.

The controller 31 that executes characteristic functions in the present embodiment includes an output processor 61, a setup unit 62, a reception switching unit 63, a movement permission acquiring unit 64, an electric field information acquiring unit 65, a timer processor 66, and a center station selector 67.

The output processor 61 extracts data to be outputted from the notification information received in the radio unit 32 and displays/outputs the data on the display 41. In a case of the terminal stations B1-Bn which includes a voice output unit (speaker), a voice output process is also performed.

The setup unit 62 stores unique information and/or a frequency of a regional broadcast radio system (herein, the first broadcast radio system 100) where it belongs to, and unique information on inter-broadcast radio system which is used to receive the notification information after participating in the inter-broadcast radio system. The unique information is a scramble code, which is a district code, as noted earlier.

The reception switching unit 63, when a house receiver moves to the communication coverage D1' of inter-broadcast radio system (here, the second broadcast radio system 100'), makes the house receiver Cx to receive the notification information by radio communication with the master station A' in the second broadcast radio system 100', based on the processes described in the embodiments 1 to 3.

The movement permission acquiring unit 64 acquires, from the master station A in the first broadcast radio system, permission information that permits the house receiver to participate in the radio communication with the master station A' in the second broadcast radio system 100', when a house receiver moves to the communication coverage D1' in inter-broadcast radio system. This permission information is added to the broadcast.

The electric field information acquiring unit 65 determines that a house receiver is got out of the first broadcast radio system 100, if a received electric field intensity of the radio frequency has declined. Thus, in order to make the house receiver participate in inter-broadcast radio system, it scans a certain frequency band, to know whether inter-broadcast radio system exists nearby.

The timer processor 66 executes the timer control process S60 described in the Third Embodiment.

The center station selector 67 selects, when a house receiver has moved from its participated regional broadcast radio system, a master station to receive the notification information therefrom.

The embodiments can be summarized as follows.

The regional broadcast radio system in which a master station is connected, by radio, to terminals directly or through a relay station, and the terminals receive and output notification information that is broadcasted from the master station.

In the regional broadcast radio system, each of the terminals includes a movement permission acquiring unit for acquiring, when the terminal moves from a communication coverage of a regional broadcast radio system where it has belonged to, to a communication coverage of inter-broadcast radio system, a reception permission (control information) from a master station in its own regional broadcast radio system which allows the terminal to receive notification information from a master station of the inter-broadcast radio system, and a reception switching unit for switching, if the reception permission is granted, the reception of the terminal to receive the notification information broadcasted from the master station of the inter-broadcast radio system.

The terminal further includes an electric field information acquiring unit for acquiring radio electric field information received from the central station devices, and the reception switching unit refers to the electric field information when switches the reception. For example, the electric field information is a parameter used for determining the reception state such as a bit error rate (BER), besides the electric field intensity.

Further, the terminal includes a unique information acquiring unit for acquiring, from the master stations, unique information (district code as a scramble code) set for the respective master stations, and a setup unit for storing unique information of a master station that grants permission. The reception switching unit receives the notification information from a master station corresponding to the unique information that is stored in the setup unit.

Moreover, the terminal includes a timer processing unit, which acquires, from the center station of its own regional broadcast radio system, information of a valid period for allowing the terminal to perform broadcast communication with a master station in the inter-broadcast radio system, and which receives the notification information from the master station of the inter-broadcast radio system in the acquired valid period.

In the regional broadcast radio system, the master station transmits to the terminals the notification information including control information for permitting the reception of notification information from another master station. Further, the master station notifies the terminals of a valid period for enabling the reception of broadcast communications to.

While the present invention has been described with respect to the preferred embodiments, it will be apparent to those skilled in the art that various changes and modifications may be made without departing from the scope of the invention as defined in the following claims.

In accordance with the present invention, the master station generates control information upon necessity and transmits information, by radio, to the child station device (terminal), while the child station device interprets the received input electric field information, control information, or notification information and selects notification it should receive, such that effective notification can be executed between the master station and the child station device.

While the invention has been shown and described with respect to the embodiments, it will be understood by those skilled in the art that various changes and modification may be made without departing from the scope of the invention as defined in the following claims.

What is claimed is:

1. Terminals for use in a regional broadcast radio system, comprising a master station connected, by radio, to the terminals directly or through predetermined relay stations, the terminals receiving and outputting notification information broadcasted from the master station, wherein each of the terminals includes:

a measuring unit for measuring an electric field value of a received signal having a specific frequency;

a comparing unit for comparing the electric field value of the received signal with a predetermined electric field value;

a scanning unit for scanning a specific frequency band when the electric field value of the received signal is equal to or less than the predetermined electric field value;

a frequency detecting unit for detecting a frequency of a maximum received electric field;

an information detecting unit for detecting whether notification information is included in a reception signal having the frequency detected by the frequency detecting unit;

an acquiring unit for acquiring a district code from the notification information detected by the information detecting unit; and a district code changing unit for setting the acquired district code as a district code of said each of the terminals.

2. The terminals of claim 1, wherein said each of the terminals further includes:

a control information unit for receiving control information which includes a reception permission received from the master station in the regional broadcast radio system, the reception permission allowing the terminal to receive notification information from a master station of another regional broadcast radio system, when said each of the terminals moves, from a communication coverage of the regional broadcast radio system to which said each of the terminals has belonged, to a communication coverage of the another regional broadcast radio system;

a determination unit for determining whether moving is granted based on the control information; and a reception switching unit for switching reception of said each of the terminals to receive the notification information from the master station of the another regional broadcast radio system, wherein if the determination unit determines that the moving is granted, the reception of the terminal is switched to receive the notification information from the master station of said another regional broadcast radio system by the reception switching unit and the district code of the terminal is changed by the district code changing unit.

3. The terminals of claim 2, wherein said each of the terminals further includes:

a period reception unit for receiving switching validity period information; and a counter unit, wherein when a counted value of the counter unit exceeds a validity period of the switching validity period information, the district code of the terminal is changed back to its previous district code by the district code changing unit.

4. A regional broadcast radio system comprising a master station connected, by radio, to terminals directly or through predetermined relay stations, the terminals receiving and outputting notification information broadcasted from the master station, wherein each of the terminals comprises:

a movement permission acquiring unit for acquiring, when said each of the terminals moves, from a communication coverage of the regional broadcast radio system to which said each of the terminals has belonged, to a communication coverage of another regional broadcast radio system, a reception permission received from the master station in the regional broadcast radio system allows said each of the terminals to receive notification information from a master station of said another regional broadcast radio system; and a reception switching unit for switching, if the reception permission is granted, a reception of said each of the terminals to receive the notification information broadcasted from the master station in the another regional broadcast radio system, and wherein the master station transmits to said each of the terminals, together with the notification information, control information for permitting the reception of the notification information received from the master station in another regional broadcast system.

5. The system of claim 4, wherein said each of the terminals further includes:

a period reception unit for receiving switching validity period information;

a counter unit; and a district code changing unit for setting a district code of said each of the terminals, wherein when a counted value of the counter unit exceeds a validity period of the switching validity period information, a district code of the terminal is changed back to its original district code by the district code changing unit, and the master station transmits to said each of the terminals the control information including a district code and the switching validity period information corresponding thereto.

6. A regional broadcast radio receiving method for use in a regional broadcast radio system comprising a master station connected, by radio, to terminals directly or through predetermined relay stations, the terminals receiving and outputting notification information broadcasted from the master station, wherein the master station transmits to the terminals, together with the notification information, control information including a reception permission for permitting a reception of notification information received from a master station in another regional broadcast system, and wherein each of terminals:

receives the control information including the reception permission received from the master station in the regional broadcast radio system which allows said each of the terminals to receive notification information from the master station of the another regional broadcast radio system, when said each of the terminals moves, from a communication coverage of the regional broadcast radio system to which said each of the terminals has belonged, to a communication coverage of the another regional broadcast radio system;

confirms the reception permission of the received control information; and receives the notification information from the master station in the another regional broadcast radio system if the reception permission is granted.

7. The method of claim 6, wherein the master station transmits to said each of the terminals switching validity period information by adding it into the control information and said each of the terminals receives the control information with the switching validity period information, so that when a validity period in the switching validity period information expires, said each of the terminals receives the notification information from the master station in the regional broadcast radio system, to which the terminal station previously belonged.

* * * * *